US006334042B1

(12) United States Patent
Quesnel

(10) Patent No.: US 6,334,042 B1
(45) Date of Patent: Dec. 25, 2001

(54) SIDE SHIFTING CLEANING APPARATUS AND METHOD

(75) Inventor: Lisbeth S. Quesnel, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/722,637

(22) Filed: Nov. 28, 2000

(51) Int. Cl.[7] ..... G03G 21/00

(52) U.S. Cl. ..... 399/353; 15/256.53; 399/357; 430/125

(58) Field of Search ..... 399/353, 357, 399/343, 327, 326, 100, 101, 71; 15/256.53, 256.51, 256.5; 430/125

(56) References Cited

U.S. PATENT DOCUMENTS

| | | | | |
|---|---|---|---|---|
| 3,854,814 | * | 12/1974 | Jones | 15/256.53 X |
| 3,980,423 | | 9/1976 | Latone | 432/75 |
| 3,980,424 | | 9/1976 | Latone | 432/75 |
| 4,627,261 | | 12/1986 | Schiller | 72/241.8 |
| 4,916,493 | | 4/1990 | DeVito | 399/402 |
| 4,999,678 | * | 3/1991 | Tange | 399/357 X |
| 5,226,639 | | 7/1993 | Kida et al. | 271/109 |
| 5,244,138 | | 9/1993 | Blanding et al. | 226/174 |
| 5,280,901 | | 1/1994 | Smith et al. | 271/188 |
| 5,572,293 | * | 11/1996 | Kikuchi et al. | 399/357 |
| 5,907,986 | | 6/1999 | Buchacher | 83/156 |

FOREIGN PATENT DOCUMENTS

| | | | |
|---|---|---|---|
| 05-053489 | * | 3/1993 | (JP) . |
| 11-219088 | * | 8/1999 | (JP) . |

* cited by examiner

*Primary Examiner*—Sophia S. Chen
(74) *Attorney, Agent, or Firm*—Oliff & Berridge, PLC

(57) ABSTRACT

A method and apparatus for increasing the useful life of cleaning members within an image forming apparatus by side shifting a cleaning member laterally in relation to a photoreceptor. In various exemplary embodiments, the cleaning apparatus includes a cleaning member mounted on a shaft, and side shifting member that moves the shaft along its axis to move the cleaning member laterally. In various exemplary embodiments, the cleaning apparatus moves the cleaning member laterally in a continuous sweeping motion. In various exemplary embodiments, the cleaning apparatus moves the cleaning member laterally in incremental steps.

27 Claims, 3 Drawing Sheets

SIDE SHIFTING CLEANING APPARATUS AND METHOD

BACKGROUND OF THE INVENTION

1. Field of Invention

This invention relates a cleaning apparatus of an image forming apparatus.

2. Description of Related Art

In current toner image forming apparatus, toner is used to produce an image on a copy sheet. After a copy has been made, any excess toner that remains on a photoreceptor drum or belt must be removed to prepare the photoreceptor drum or belt for the next copy. This is accomplished in part, by using one or more cleaning brushes mounted in the image forming apparatus. The cleaning brushes are removed and replaced periodically when excessive use causes the cleaning brushes to lose efficiency in removing toner from the photoreceptor drum or belt.

SUMMARY OF THE INVENTION

One of the primary failure modes of a cleaning brush is the excess build-up of toner in the brush. The excess build-up of toner is a result of concentrations of toner that remain on certain portions of the photoreceptor after transferring the developed image to a copy sheet.

The build-up of toner on the photoreceptor causes the cleaning brush to experience uneven wear and/or build-up of toner on the cleaning brush corresponding to the areas of the toner build-up on the photoreceptor. The uneven wear and/or build-up of toner on the cleaning brush reduces the useful life of the cleaning brush, in that the cleaning brush must be replaced even though the cleaning brush has only experienced excessive wear and/or build-up of toner on the cleaning brush over a small portion of the surface of the cleaning brush.

In addition, build-ups of toner in certain areas of the cleaning brush decrease the cleaning efficiency of the cleaning brush. As a result, excess toner remains on the photoreceptor, thus reducing the quality of subsequent copies.

This invention provides apparatus and methods for increasing the life of a cleaning brush in an image forming apparatus.

This invention provides apparatus and methods for increasing the efficiency of a cleaning brush in an image forming apparatus.

This invention provides apparatus and methods that reduce the rate at which a cleaning brush must be replaced in an image forming apparatus, further reducing the associated operating costs. In various exemplary embodiments, the useful life of the cleaning brush is increased by side shifting the cleaning brush laterally along the rotational axis of the photoreceptor drum or belt, either continuously during imaging, or incrementally at prescribed intervals. By shifting the cleaning brush laterally along the rotational axis of the photoreceptor drum or belt, the area of the cleaning brush that comes into contact with the portion of the photoreceptor drum or belt that experiences excessive toner build-up increases. As a result, the area of the surface of the brush that experiences greater wear and/or build-up of toner increases and the useful life of the brush is extended. The brush should be expected to fail when the entire designated sweep area has experienced wear, as opposed to the premature failure without the side shifting the brush.

By shifting the cleaning brush the instance of toner build up on the photoreceptor is reduced, thus improving the overall quality of copies made by the image forming apparatus.

In various exemplary embodiments, this invention provides a side shifting cleaning apparatus having a side shifting member that moves a cleaning member laterally.

In various exemplary embodiments, this invention provides a side shifting cleaning apparatus having a rack and pinion system that moves a cleaning member laterally.

In various exemplary embodiments, this invention provides a side shift cleaning apparatus having a planetary gear system that moves a cleaning member laterally.

In various exemplary embodiments, this invention provides a side shift cleaning apparatus having a cam-follower system that moves a cleaning member laterally.

In various exemplary embodiments, this invention provides a side shift cleaning apparatus having a barrel cam-follower system that moves a cleaning member laterally.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

Figure 1:
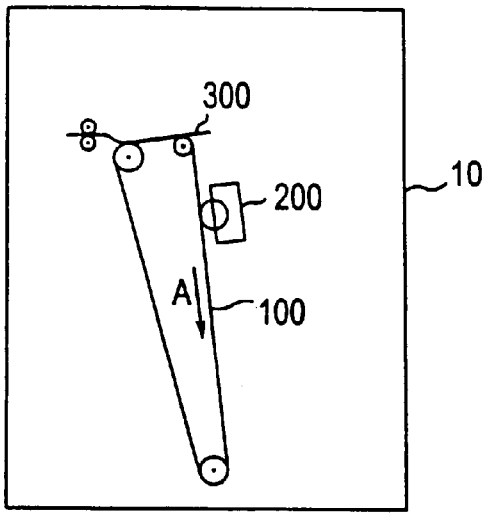
FIG. 1 is a schematic representation of an image forming apparatus having a side shifting cleaning apparatus according to this invention.

FIG. 1 shows a schematic representation of an exemplary embodiment of an image forming apparatus 10 according to this invention. The image forming apparatus 10 includes a photoreceptor belt 100 and a side shifting cleaning apparatus 200 that is adjacent to and in contact with the photoreceptor belt 100. The image forming apparatus 10 may be any known or later-developed image forming apparatus that includes a photoreceptor belt, or drum, or any other known or later-developed photoreceptor structure.

The image forming apparatus 10 forms a latent image of an image to be formed on the photoreceptor 100 using any appropriate conventional or later-developed process and/or devices.

The photoreceptor 100 rotates in a process or slow-scan direction A. Toner is applied to develop the latent image on the photoreceptor 100 into a developed image using any appropriate conventional or later-developed process and/or devices. The image forming apparatus 10 transfers the developed image from the photoreceptor 100 to an image receiving medium 300, such as, for example, paper. The developed image may be transferred using any appropriate conventional or later-developed process and/or devices. Additionally, some developed images and/or some developed areas on the photoreceptor are intentionally not transferred to the image receiving medium. These include test patches and areas of the photoreceptor that are beyond the edges of the image receiving medium.

The toner remains on the photoreceptor 100. The photoreceptor 100 needs to be cleaned to remove remaining toner before another latent image can be formed on the photoreceptor 100. The photoreceptor 100 passes by the side shifting cleaning apparatus 200 to be cleaned of this remaining toner.

The toner that remains on the photoreceptor 100 may result from failing to completely transfer toner in the image areas from the photoreceptor 100 to the imaging receiving medium 300. Conventional image forming apparatus do not transfer the developed image with 100% efficiency. Generally, about 2% to 3% of the toner in the image areas remains on the photoreceptor 100 after the developed image is transferred.

The toner may also remain on the photoreceptor 100 due to "overshooting." Overshooting occurs when the toner is applied to an area on the photoreceptor 100 that is outside the printable surface area of the image receiving medium 300. Overshooting generally occurs when toner is to be applied to the edge of the image receiving medium 300, i.e., in "edge-to-edge" printing. In this case all of the toner on the photoreceptor 100, that is outside of the image area of the image receiving medium 300 needs to be removed or cleaned from the photoreceptor 100. These areas of high toner concentrations can cause premature and uneven wear in conventional cleaning devices.

The toner remaining on the photoreceptor may also be due to process control patches. Process control patches are developed images on the photoreceptor 100 that are used to observe various process parameters. In many image forming systems, these test patches are not transferred to the image receiving medium 300. All of the toner in these test patches need to be removed from the photoreceptor 100 by the cleaning apparatus. These large toner densities can cause a conventional cleaning device to fail in an unacceptably short period of time.

It should be understood that there may be other reasons why toner remains on the photoreceptor 100. The side-shifting cleaning apparatus 200 will assist in removing the toner that remains on photoreceptor 100, while, in various exemplary embodiments, extending the life of the side shifting cleaning apparatus 200 and/or increasing the efficiency of removing toner from the photoreceptor 100, compared to conventional cleaning devices.

Figure 2:
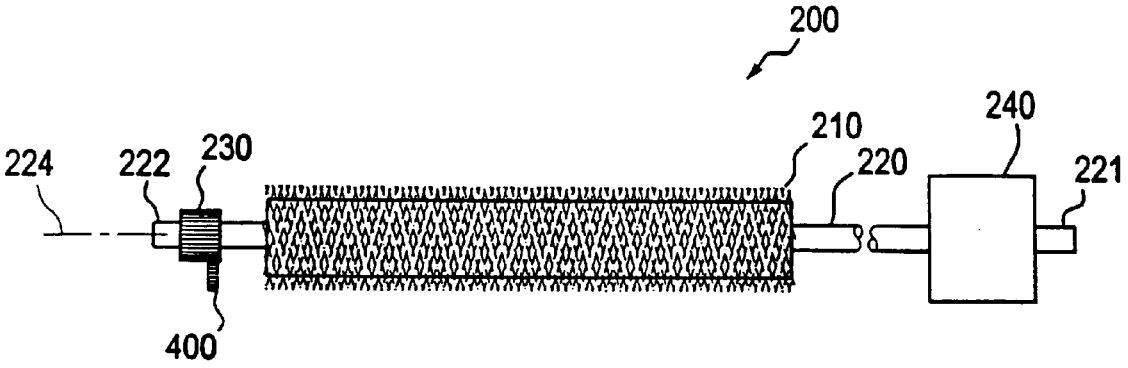
FIG. 2 shows a front view of a first exemplary embodiment of a side shifting cleaning apparatus according to this invention.

FIG. 2 shows a first exemplary embodiment of a side-shifting cleaning apparatus 200 according to this invention. As shown in FIG. 2, the side-shifting cleaning apparatus 200 includes a cleaning member 210 that is mounted on a shaft 220. In various exemplary embodiments, the cleaning member 210 is a brush. The cleaning member 210 may be any device that can remove toner from the photoreceptor 100 and that is subject to uneven wear from removing the toner.

In various exemplary embodiments, the cleaning member 210 is fixed to the shaft 220 so that the cleaning member 210 is prevented from rotating on the shaft 220. In various exemplary embodiments, the cleaning member 210 is fixed to the shaft 220 so that the cleaning member 210 is prevented from moving axially along the shaft 220. A driven gear 230 is mounted on a first end 222 of the shaft 220 to provide a rotational force to the shaft 220.

The driven gear 230 engages a drive gear 400, shown in phantom lines. In various exemplary embodiments, the drive gear 400 is not considered part of the side shifting cleaning apparatus 200. It should be understood that the side shifting cleaning apparatus 200 can include the drive gear 400. In various exemplary embodiments, the drive gear 400 is driven or rotated by a separate device within the image forming apparatus 10. In various exemplary embodiments, the drive gear 400 is clutched to an existing drive system or motor within image forming apparatus 10.

In various exemplary embodiments, the image forming apparatus 10 includes any known or later-developed devices and methods, not shown, that determine when the photoreceptor 100 is rotating. When the photoreceptor 100 rotates, the drive gear 400 is engaged to rotate the driven gear 230. The driven gear 230 rotates the shaft 220 and the cleaning member 210 in a direction opposite the process direction A to clean toner from the surface of the photoreceptor 100.

The driven gear 230 and the drive gear 400 engage each other so that the driven gear 230 may be moved along a longitudinal axis 224, relative to the drive gear 400 and remain engaged. In various exemplary embodiments, this continuous engagement during movement of the driven gear 230 is accomplished by the driven gear 230 having a width that is greater than the width of the drive gear 400. It should be understood that other arrangements can be made with respect to how the driven gear 230 and drive gear 400 engage to accomplish the continuous engagement between the driven gear 230 and the drive gear 400 during movement of the driven gear 230 relative to the drive gear 400 along the longitudinal axis 224.

The side-shifting cleaning apparatus 200 includes a side-shifting member 240. In various exemplary embodiments, the side-shifting member 240 is disposed at a second end 221 of the shaft 220. In various exemplary embodiments, the side-shifting member 240 is mounted on the shaft. In other various exemplary embodiments, the side-shifting member 240 is mounted on a different shaft other than the shaft 220, wherein the different shaft is linked to the shaft 220 through any known or later-developed mechanical, hydraulic, pneumatic, fluid or electro-mechanical devices, such as clutches, belts or the like, so that rotation or movement of the different shaft will cause a predetermined rotation or movement of the shaft 220.

The side shifting member 240 is adapted to move the shaft 220 along the longitudinal axis 224. In various exemplary embodiments, the side-shifting member 240 moves the shaft in continuous back-and-forth sweeping motions along the axis 224. In various other exemplary embodiments, the side-shifting member 240 moves the shaft in incremental movements along the longitudinal axis 224 over time.

The cleaning member 210 will move in conjunction with any movement of the shaft 220. Moving the cleaning member 210 along the longitudinal axis 224 will move the cleaning member 210 relative to the photoreceptor 100. Moving the cleaning member 210 along the longitudinal axis 224 will expose different surface areas of the cleaning member 210 to different portions of the photoreceptor 100, such that the same area of the cleaning member 210 will not be continuously exposed to an area of the photoreceptor having high toner concentrations.

Figure 3:
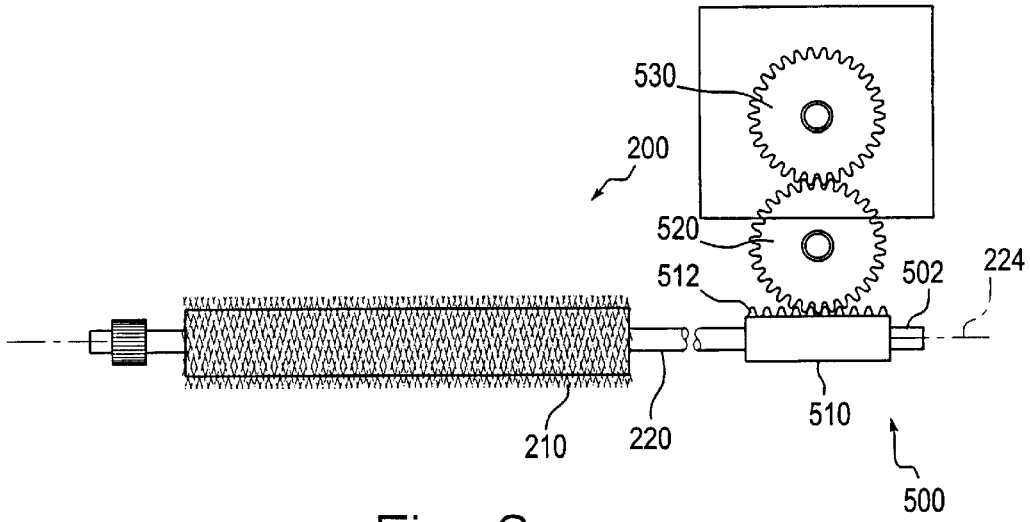
FIG. 3 is a front view of a second exemplary embodiment a side shifting member according to this invention.

FIG. 3 shows a second exemplary embodiment of a side-shifting member 500. The side-shifting member 500 includes a rack sleeve 510. The rack sleeve 510 is mounted to a shaft 502. The shaft 502 rotates freely within the rack sleeve 510. The rack sleeve 510 is mounted around the shaft 502 to prevent the shaft 220 from moving axially within the rack sleeve 510. The rack sleeve 510 has an area on its surface with a number of teeth 512. In various exemplary embodiments, the shaft 502 is the shaft 220. In other various exemplary embodiments, the shaft 502 is linked to the shaft 220 through any known or later-developed mechanical, hydraulic, pneumatic, fluid or electro-mechanical devices, such as clutches, belts or the like, so that rotation or movement of the shaft 502 will cause a corresponding/predetermined rotation or movement of the shaft 220.

The side-shifting member 500 includes a pinion gear 520. The pinion gear 520 engages the teeth 512 of the rack sleeve 510. Upon rotating the pinion gear 520, the rack sleeve 510 moves along the longitudinal axis 224 in a direction that corresponds to the rotational direction of the pinion gear 520. The shaft 220 will move in conjunction with the movement of the rack sleeve 510 along the longitudinal axis 224. When the shaft 220 moves along the longitudinal axis 224, the cleaning member 210 will also move along the longitudinal axis 224.

In various exemplary embodiments, the pinion gear 520 is rotated incrementally during the image forming process. In various other exemplary embodiments, the pinion gear 520 is rotated continuously during the image forming process. The pinion gear 520 is rotated in clockwise or counter-clockwise directions. A combination of clockwise and counter-clockwise rotations of the pinion gear 520 will shift the cleaning member 210 from side to side relative to the photoreceptor 100 through-out the lifetime of the cleaning member 210.

In various exemplary embodiments, the pinion gear 520 is driven by a pinion drive gear 530. The pinion drive gear 530 may be linked to or driven by a motor or some other drive system of the image forming apparatus 10.

Figure 4:
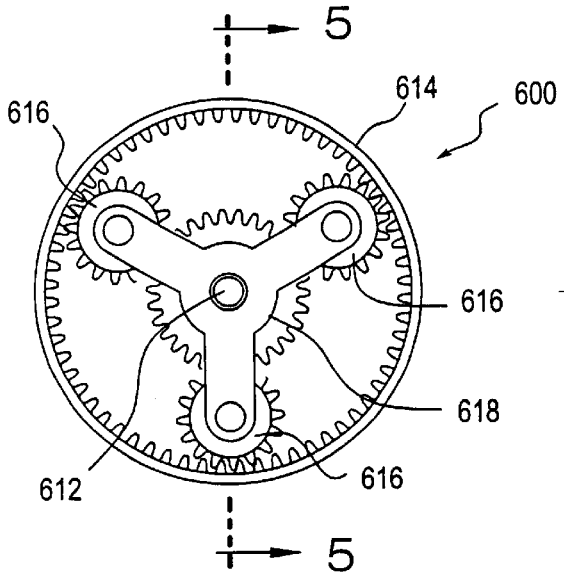
FIG. 4 is a front plan view of one exemplary embodiment of a planetary gear set usable to shift a side shifting member apparatus according to this invention.
Figure 5:
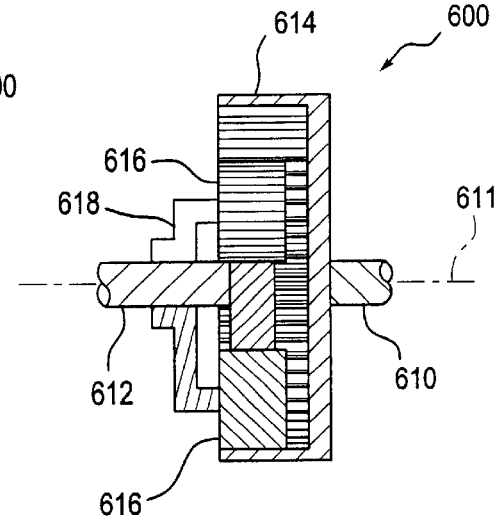
FIG. 5 is a side cross sectional view of the planetary gear set shown in FIG. 4.

FIG. 4 is a front plan view of a planetary gear system 600, an exemplary embodiment of a drive portion of a side shifting member 240 that allows for the reciprocation of the cleaning member 210. FIG. 5 is a side cross-sectional view of the planetary gear system 600 taken along line 5—5 of FIG. 4. As shown in FIGS. 4 and 5, the side-shifting member includes the planetary gear system 600 according to this invention. The side-shifting member 600 includes an input shaft 610, an output shaft 612, a ring gear 614, a plurality of planet gears 616, and a sun gear 618.

The input shaft 610 is fixed to the ring gear 614. The ring gear 614 engages the planet gears 616. The planet gears 616 engage the sun gear 618. The planet gears 616 are disposed between the sun gear 618 and the ring gear 614 and continuously engage both the sun gear 618 and the ring gear 614. The sun gear 618 is fixed to the output shaft 612. When the input shaft 610 rotates, the ring gear 614 will rotate in a corresponding direction about an axis 611. Rotating the ring gear 614 about the axis 611 will rotate the planet gears 616 about their respective axes in a corresponding direction. Rotating the planet gears 616 will rotate the sun gear 618 about the axis 611 in a direction opposite to the rotation direction of the ring gear 614. Rotating the sun gear 618 will rotate the output shaft 612 in a corresponding direction.

The rotation of the input shaft 610 corresponds to the rotation of the cleaning member 210. In various exemplary embodiments, the input shaft 610 is linked to the shaft 220 through any known or later-developed mechanical, hydraulic, pneumatic, fluidic or electro-mechanical devices, such as clutches, belts or the like. The input shaft 610 will rotate in conjunction with the rotation of the shaft 220. In various other exemplary embodiments, the input shaft 610 is linked using any known or later-developed mechanical, hydraulic, pneumatic, fluidic or electro-mechanical devices to the driven gear 230. In still other various exemplary embodiments, the input shaft 610 is linked using any known or later-developed mechanical, hydraulic, pneumatic, fluidic or electro-mechanical devices to the drive gear 400. In yet other various exemplary embodiments, the input shaft 610 is linked using any known or later-developed mechanical, hydraulic, pneumatic, fluidic or electro-mechanical devices to a device or system of the image forming apparatus 10 that rotates directly or indirectly the cleaning member 210.

In contrast, in various other exemplary embodiments, the output shaft 612 is linked to the shaft 220 using at least one known or later-developed mechanical, hydraulic, pneumatic, fluidic or electro-mechanical devices, such as clutches, gears, belts, rack and pinion systems or the like. In various exemplary embodiments, the output shaft 612 is linked to the shaft 220 so that upon the output shaft 612 being rotated, the shaft 220 will move along the longitudinal axis 224. Rotating the output shaft 612 in a clockwise direction will move the shaft 220 in a first direction along the longitudinal axis 224, while rotating the output shaft 612 in a counter-clockwise direction will move the shaft 220 in a second direction along the longitudinal axis 224. The first direction of the shaft 220 is opposite to the second direction.

In various exemplary embodiments, planetary gear system 600 moves the cleaning member 210 along the longitudinal axis 224 in a continuously sweeping fashion from side to side relative to the photoreceptor 100. In various other exemplary embodiments, the side shifting member moves the cleaning member 210 along the longitudinal axis 224 in an incremental fashion over time.

In various exemplary embodiments, the planetary gear system 600 moves the cleaning member 210 along the longitudinal axis 224 a predetermined distance based on the number of rotations that cleaning member 210 has experienced. In various exemplary embodiments, the planetary gear system 600 has a gear ratio of about 3,000:1 between the input shaft 610 and the output shaft 612. In various exemplary embodiments, the planetary gear system 600, may reverse rotation directions, which will reverse the movement direction of the cleaning member 210 along the axis 224.

Figure 6:
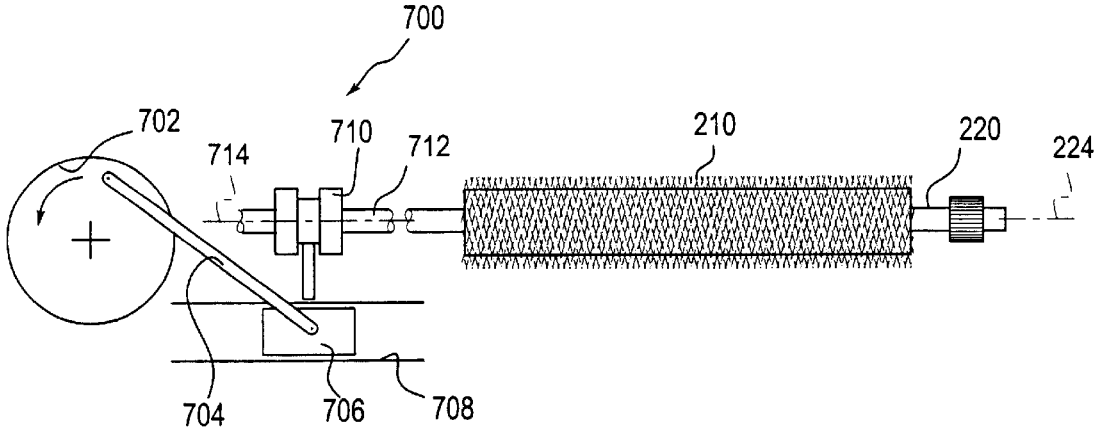
FIG. 6 is a schematic view of a third exemplary embodiment of a side shifting member apparatus according to this invention.

FIG. 6 is a plan view of a fourth exemplary embodiment of a side-shifting member 700 according to this invention. The side-shifting member 700 includes a crank 702, an arm 704, a cam 706, a cam track 708, a cam follower 710 and an output shaft 712.

In various exemplary embodiments, the crank 702 is driven or rotated by any known or later-developed devices or systems within the image forming apparatus 10, such as a motor, or the like. In various exemplary embodiments, the crank 702 is driven off of the shaft 220, using any known or later-developed mechanical, hydraulic, pneumatic, fluidic or electro-mechanical devices. In various other exemplary embodiments, the crank 702 is driven off of the driven gear 230, using any known or later-developed mechanical, hydraulic, pneumatic, fluidic or electro-mechanical devices. In various other exemplary embodiments, the crank 702 is driven off of the drive gear 400, using any known or later-developed mechanical, hydraulic, pneumatic, fluidic or electro-mechanical devices.

The arm 704 is rotatably attached to the crank 702 and the cam 706. The cam follower 710 is mounted on the output shaft 712, which has an axis 714. The cam follower is attached to the cam 706. When the crank 702 rotates, the arm 704 will push and pull the cam 706 along the cam track 708. Movement of the cam 706 along the cam track 708 urges the cam follower 710 to move the output shaft 712 along the axis 714.

Moving the output shaft 712 along the axis 714 causes the cleaning member 210 to move correspondingly along the longitudinal axis 224. In various exemplary embodiments, the output shaft 712 is the shaft 220. In various other exemplary embodiments, the output shaft 712 is linked to the shaft 220.

Rotating the crank 702 moves the cleaning member 210 along the longitudinal axis 224. In various exemplary embodiments, rotating the crank 702 moves the cleaning member 210 in a continuous sweeping motion from side to side relative to the photoreceptor 100 and along the longitudinal axis 224. In various other exemplary embodiments, rotating of crank 702 moves the cleaning member in an incremental fashion relative to the photoreceptor 100 along the longitudinal axis 224.

Figure 7:
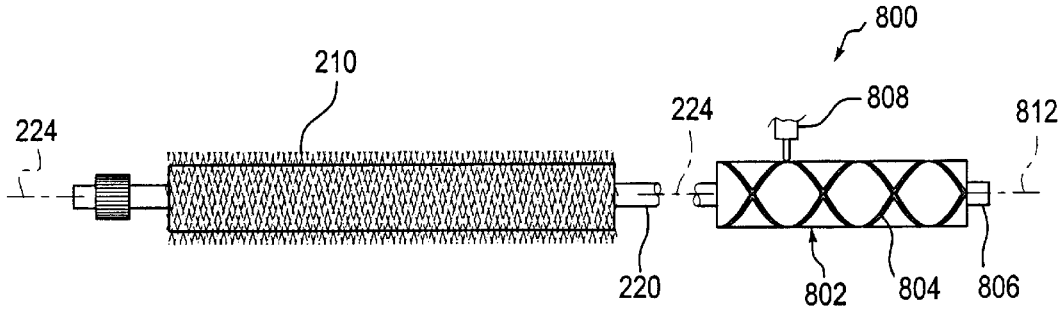
FIG. 7 is a schematic view of a fourth exemplary embodiment of a side shifting member apparatus according to this invention.

FIG. 7 is a side view of a fifth exemplary embodiment of a side-shifting member 800. The side shifting member 800 includes a barrel cam 802 having surface slots 804, a barrel cam shaft 806, and a cam follower 808.

The barrel cam 802 is mounted on the barrel cam shaft 806. When the barrel cam shaft 806 rotates, the barrel cam 802 will correspondingly rotate.

In various exemplary embodiments, the cam follower 808 is fixed relative to the barrel cam 802. The cam follower 808 engages the surface slots 804 on the barrel cam 802. When the barrel cam 802 rotates, the cam follower 808 will travel in the slots 804 such that the barrel cam 802 and the barrel cam shaft 806 move along an axis 812.

Moving the barrel cam shaft 806 along the axis 810 causes the cleaning member 210 to move correspondingly along the longitudinal axis 224. In various exemplary embodiments, the barrel cam shaft 806 is the shaft 220. In other various other exemplary embodiments, the barrel cam shaft 806 is linked to the shaft 220.

In various exemplary embodiments, the barrel cam shaft 806 is driven or rotated using any known or later-developed devices or systems within the image forming apparatus 10, such as a motor, or the like. In various exemplary embodiments, the barrel cam shaft is driven off of the shaft 220 using any known or later-developed mechanical, hydraulic, pneumatic, fluidic or electro-mechanical devices. In various other exemplary embodiments, the barrel cam shaft 806 is driven off of the driven gear 230 using any known or later-developed mechanical, hydraulic, pneumatic, fluidic or electro-mechanical devices. In other various exemplary embodiments, the barrel cam shaft 806 is driven off of the drive gear 400, using any known or later-developed mechanical, hydraulic, pneumatic, fluidic or electro-mechanical devices.

Moving of the barrel cam shaft 806 along the axis 810 moves the cleaning member 210 along the longitudinal axis 224. In various exemplary embodiments, moving the barrel cam shaft 806 along the axis 810 moves the cleaning member 210 in a continuous sweeping motion from side to side relative to the photoreceptor 100 and along the longitudinal axis 224. In other various exemplary embodiments, the moving of the barrel cam shaft 806 moves the cleaning member in an incremental fashion relative to the photoreceptor 100 along the longitudinal axis 224.

It should be appreciated that the cam follower 808 may, in various other exemplary embodiments, be linked or attached to the shaft 220 to move with the cam follower 808. In this case, the barrel cam 802 may be positionally fixed relative to the cleaning member 210.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A cleaning apparatus for use with an image forming apparatus, comprising:

a cleaning member; and a side shifting member linked to the cleaning member, wherein the side shifting member comprises:

a rack sleeve mounted on a rack shaft;

a pinion gear engaging the rack sleeve, wherein rotation of the pinion gear moves the rack sleeve and the rack shaft along a longitudinal axis of the rack shaft; and wherein the rack shaft is coupled to the cleaning member to move the cleaning member along the longitudinal axis.

2. A cleaning apparatus as recited in claim 1, wherein:

the cleaning member is mounted on a cleaning member shaft; and the rack shaft is the cleaning member shaft.

3. A cleaning apparatus as recited in claim 1, wherein the side shifting member is a gear reduction unit.

4. A cleaning apparatus as recited in claim 3, wherein the gear reduction unit is a planetary gear system.

5. A cleaning apparatus as recited in claim 4, wherein the planetary gear system is reversible and provides reciprocal movement of the rack sleeve.

6. A cleaning apparatus as recited in claim 1, wherein the side shifting member incrementally moves the cleaning member along the longitudinal axis.

7. A cleaning apparatus as recited in claim 1, wherein the side shifting member moves the cleaning member along the longitudinal axis in a continuous motion.

8. A cleaning apparatus as recited in claim 1, wherein the side shifting member moves the cleaning member after the cleaning member experiences a threshold number of rotations about the longitudinal axis.

9. An image forming apparatus, comprising:

a photoreceptor; and the cleaning apparatus of claim 4.

10. An image forming apparatus as recited in claim 9, wherein the side shifting member sweeps the cleaning member along the longitudinal axis relative to a first edge and a second edge of the photoreceptor surface.

11. An image forming apparatus as recited in claim 9, wherein the side shifting member is moved in one direction relative to a first edge of the photoreceptor.

12. A cleaning apparatus as recited in claim 1, wherein the cleaning member is a brush mounted on a cleaning member shaft.

13. A cleaning apparatus as recited in claim 12, wherein the side shifting member is linked to the cleaning member shaft.

14. A cleaning apparatus for use with an image forming apparatus, comprising:

a cleaning member; and a side shifting member linked to the cleaning member, wherein the side shifting member comprises:

a crank;

a cam movable within a cam track;

an arm rotatably connected to the crank and rotatably connected to the cam, wherein rotation of the crank is translated into movement of the cam;

a cam follower fixed to an output shaft and linked to the cam, wherein the movement of the cam is translated into movement of the cam follower and the output shaft along an axis; and wherein the output shaft is coupled to the cleaning member to move the cleaning member along a longitudinal axis.

15. A cleaning apparatus as recited in claim 14, wherein:

the cleaning member is mounted on a cleaning member shaft; and the output shaft is the cleaning member shaft.

16. A cleaning apparatus as recited in claim 14, wherein the side shifting member incrementally moves the cleaning member along the longitudinal axis.

17. A cleaning apparatus as recited in claim 14, wherein the side shifting member moves the cleaning member along the longitudinal axis in a continuous motion.

18. A cleaning apparatus as recited in claim 14, wherein the side shifting member moves the cleaning member after the cleaning member experiences a threshold number of rotations about the longitudinal axis.

19. A cleaning apparatus for use with an image forming apparatus, comprising:

a cleaning member; and a side shifting member, wherein the side shifting member comprises:

a barrel cam having slots, the barrel cam being mounted on a barrel cam shaft having an axis; and a cam follower engaging the slots, wherein rotation of the barrel cam shaft moves the barrel cam and the barrel cam shaft along the axis of the barrel cam shaft relative to the cam follower, wherein the barrel cam shaft is coupled to the cleaning member to move the cleaning member along a longitudinal axis.

20. A cleaning apparatus as recited in claim 19, wherein:

the cleaning member is mounted on a cleaning member shaft; and the barrel cam shaft is the cleaning member shaft.

21. A cleaning apparatus as recited in claim 19, wherein the side shifting member incrementally moves the cleaning member along the longitudinal axis.

22. A cleaning apparatus as recited in claim 19, wherein the side shifting member moves the cleaning member along the longitudinal axis in a continuous motion.

23. A cleaning apparatus as recited in claim 19, wherein the side shifting member moves the cleaning member after the cleaning member experiences a threshold number of rotations about the longitudinal axis.

24. A method for increasing cleaning member efficiency in an image forming apparatus, having a photoreceptor surface to be cleaned, comprising:

providing the cleaning member adjacent the photoreceptor surface; and moving the cleaning member laterally along an axis of the cleaning member relative to the photoreceptor surface after the cleaning member experiences a threshold number of rotations about the axis of the cleaning member.

25. The method as recited in claim 24, wherein the cleaning member moves incrementally.

26. The method recited in claim 24, wherein the cleaning member moves in a sweeping motion, wherein the cleaning member sweeps relative to a first edge and a second edge of the photoreceptor surface.

27. The method recited in claim 24, wherein moving the cleaning member in one direction relative to a first edge of the photoreceptor surface.

* * * * *